US012780384B2

(12) United States Patent
Hooker

(10) Patent No.: US 12,780,384 B2
(45) Date of Patent: Nov. 3, 2026

(54) ELECTRIC ACTUATOR FOR A MARINE STEERING SYSTEM

(71) Applicant: Schaeffler Technologies AG & Co. KG, Herzogenaurach (DE)

(72) Inventor: Craig Hooker, Indian Land, SC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 290 days.

(21) Appl. No.: 18/616,439

(22) Filed: Mar. 26, 2024

(65) Prior Publication Data

US 2024/0326972 A1 Oct. 3, 2024

Related U.S. Application Data

(60) Provisional application No. 63/463,083, filed on May 1, 2023, provisional application No. 63/454,972, filed on Mar. 28, 2023.

(51) Int. Cl.
*B63H 20/12* (2006.01)
*B63H 20/10* (2006.01)

(52) U.S. Cl.
CPC ..... *B63H 20/12* (2013.01); *B63H 20/10* (2013.01)

(58) Field of Classification Search
CPC ..... B63H 20/12
See application file for complete search history.

(56) References Cited

U.S. PATENT DOCUMENTS 9,944,377 B2 4/2018 Davidson et al.
10,435,130 B2 10/2019 Davidson et al.
10,518,858 B1 * 12/2019 Klawitter ..... B63H 20/16
10,940,927 B2 3/2021 Chan et al.
10,981,638 B2 4/2021 Redfern et al.
10,988,224 B2 4/2021 Davidson et al.
11,273,894 B2 3/2022 Wong et al.
2016/0201776 A1 * 7/2016 Takase ..... F16H 25/2204 74/99 R
2019/0344868 A1 * 11/2019 Davidson ..... F16H 25/20
(Continued)

FOREIGN PATENT DOCUMENTS

CA 3048276 A1 * 12/2020 ..... B63H 20/022
CN 109630635 A * 4/2019 ..... F16H 25/2252
(Continued)

OTHER PUBLICATIONS

Panbo, "Panbo Presents: Dometic Optimus Electric Steering Preview," youtube.com/watch?v=pUFtGu2rPqU&t=27s, downloaded Mar. 20, 2024.

*Primary Examiner* — Richard G Davis
(74) *Attorney, Agent, or Firm* — Price Heneveld LLP

(57) ABSTRACT

A marine steering system includes a marine propulsion unit, a steering tiller having a first end and a second end opposite the first end and being pivotably coupled to the marine propulsion unit proximate the second end, and an electric actuator. The electric actuator includes an output shaft, a motor that drives rotation of the output shaft about an axis, and a driven assembly pivotably coupled with the steering tiller proximate the first end and operably coupled with the output shaft, such that rotation of the output shaft by the motor drives axial movement of the driven assembly relative to the output shaft and the motor to steer the marine propulsion unit via the steering tiller.

16 Claims, 4 Drawing Sheets

(56) References Cited

U.S. PATENT DOCUMENTS

| | | | | |
|---|---|---|---|---|
| 2019/0344870 | A1* | 11/2019 | Mizutani | B63H 20/12 |
| 2019/0344872 | A1* | 11/2019 | Nanjo | B63H 20/12 |
| 2024/0227919 | A1* | 7/2024 | McKernan | B62D 5/0427 |

FOREIGN PATENT DOCUMENTS

| | | | | |
|---|---|---|---|---|
| CN | 110601437 | A * | 12/2019 | H02K 7/06 |
| DE | 102020114804 | A1 * | 12/2021 | B63H 20/08 |

* cited by examiner

ELECTRIC ACTUATOR FOR A MARINE STEERING SYSTEM

CROSS-REFERENCE TO RELATED APPLICATIONS

This application claims the benefit of priority under 35 U.S.C. § 119 of U.S. Provisional Application No. 63/454,972, filed on Mar. 28, 2023, and U.S. Provisional Application No. 63/463,083, filed on May 1, 2023, the entire contents of which are incorporated herein by reference.

FIELD OF THE DISCLOSURE

The present disclosure generally relates to a marine steering system. More specifically, the present disclosure relates to a marine steering system and an electric actuator for the marine steering system.

BACKGROUND OF THE DISCLOSURE

Marine vessels can include steering systems that have an electric actuator. Due to limited spacing between an engine cowling and a hull of a marine vessel, it is desirable to have electric actuators for marine steering systems that have a small spatial footprint yet meet durability and performance requirements.

SUMMARY OF THE DISCLOSURE

According to a first aspect of the present disclosure, a marine steering system includes a marine propulsion unit, a steering tiller having a first end and a second end opposite the first end and being pivotably coupled to the marine propulsion unit proximate the second end, and an electric actuator. The electric actuator includes an output shaft, a motor that drives rotation of the output shaft about an axis, and a driven assembly pivotably coupled with the steering tiller proximate the first end and operably coupled with the output shaft, such that rotation of the output shaft by the motor drives axial movement of the driven assembly relative to the output shaft and the motor to steer the marine propulsion unit via the steering tiller.

Embodiments of the first aspect of the disclosure can include any one or a combination of the following features:

- the driven assembly includes a housing and a nut tube that is housed by and fixed relative to the housing and that receives a central screw that is fixedly coupled with the output shaft therein, wherein the nut tube is translatable along the axis in response to the motor rotating the output shaft;
- the marine steering system includes a roller screw assembly that includes the central screw fixedly coupled with the output shaft, the nut tube that receives the central screw therein, and a plurality of rollers disposed radially between the central screw and the nut tube and configured to engage the central screw and the nut tube;
- the plurality of rollers are non-translatably connected with the central screw, such that the axial position of each of the plurality of rollers is fixed relative to the central screw;
- the motor is arranged external to the housing;
- the motor is axially offset from the entirety of the driven assembly;
- the motor and the output shaft are coaxially aligned, such that the motor and the output shaft rotate about the axis;

- the motor includes a stator and a rotor that is configured to rotate relative to the stator about a rotor axis that is radially offset from the axis about which the output shaft rotates;
- the motor is drivably connected to the output shaft via a gearset;
- the motor is drivably connected to the output shaft via a belt;
- the driven assembly includes a pivot plate pivotably coupled to the housing and operable to pivot relative to the housing about a pivot plate axis that is parallel to the axis about which the output shaft rotates, wherein the steering tiller is pivotably coupled with the driven assembly via a pivotal coupling with the pivot plate, such that the pivot plate is operable to pivot relative to the housing about the pivot plate axis, and the steering tiller is operable to pivot relative to the pivot plate;
- the electric actuator further includes a support structure having a support arm axially offset from the housing and configured to inhibit axial movement of the output shaft, wherein the motor is housed by the support arm, such that axial movement of the motor relative to the support arm is inhibited;
- the electric actuator further includes a mounting shaft coupled to the support structure and configured to facilitate pivotal movement of the support structure, the motor, the output shaft, and the housing about a pivot axis that extends parallel to the axis and is radially offset from the axis and the pivot plate axis;
- a full stroke actuation of the electric actuator prompts pivotal movement of the support structure, the motor, the output shaft, and the housing about the pivot axis, pivotal movement of the pivot plate relative to the housing about the pivot plate axis, pivotal movement of the steering tiller relative to the pivot plate, and pivotal movement of the steering tiller relative to the marine propulsion unit; and
- the marine propulsion unit is an engine.

According to a second aspect of the present disclosure, an electric actuator for a marine steering system includes a housing, a first output shaft extending axially outward from the housing in a first axial direction, a first motor arranged external to the housing and drivingly engaged with the first output shaft, such that the first motor is operable to drive rotation of the first output shaft about an axis, and a roller screw assembly arranged within the housing and coupled to the first output shaft. The roller screw assembly has a nut tube fixed relative to the housing and a central screw received by the nut tube. Further, the nut tube is axially translatable in response to the first motor rotating the first output shaft and the central screw about the axis.

Embodiments of the second aspect of the disclosure can include any one or a combination of the following features:

- a second output shaft coupled with the roller screw assembly and extending axially outward from the housing in a second axial direction opposite the first axial direction, and a second motor arranged external to the housing and drivingly engaged with the second output shaft;
- a pivot plate pivotably coupled to the housing and operable to pivot relative to the housing about a pivot plate axis that is parallel to the axis about which the first output shaft rotates, the pivot plate being configured to have a steering tiller of the marine steering system pivotably coupled thereto; and
- rotation of the first output shaft prompts axial translation of the nut tube relative to the first motor.

According to a third aspect of the present disclosure, a marine steering system includes a marine propulsion unit, a steering tiller having a first end and a second end opposite the first end and being pivotably coupled to the marine propulsion unit proximate the second end, and an electric actuator. The electric actuator includes a housing and a pivot plate pivotably coupled with the housing and operable to pivot relative to the housing about a pivot plate axis, wherein the steering tiller is pivotably coupled with the pivot plate proximate the first end of the steering tiller, such that the pivot plate is operable to pivot relative to the housing about the pivot plate axis, and the steering tiller is operable to pivot relative to the pivot plate. The electric actuator also includes a first output shaft extending axially outward from the housing in a first axial direction and a second output shaft extending axially outward from the housing in a second axial direction opposite the first axial direction. Additionally, the electric actuator includes a first motor arranged external to the housing and drivingly engaged with the first output shaft, such that the first motor is operable to drive rotation of the first output shaft about an axis, and a second motor arranged external to the housing and drivingly engaged with the second output shaft, such that the second motor is operable to drive rotation of the second output shaft about the axis. Further, the electric actuator includes a roller screw assembly arranged within the housing and coupled to the first and second output shafts. The roller screw assembly has a nut tube fixed relative to the housing and a central screw received by the nut tube. Further, the nut tube is configured to axially translate along the axis in response to rotation of the central screw via at least one of the first motor driving rotation of the first output shaft and the second motor driving rotation of the second output shaft.

These and other features, advantages, and objects of the present disclosure will be further understood and appreciated by those skilled in the art by reference to the following specification, claims, and appended drawings.

Figure 1:
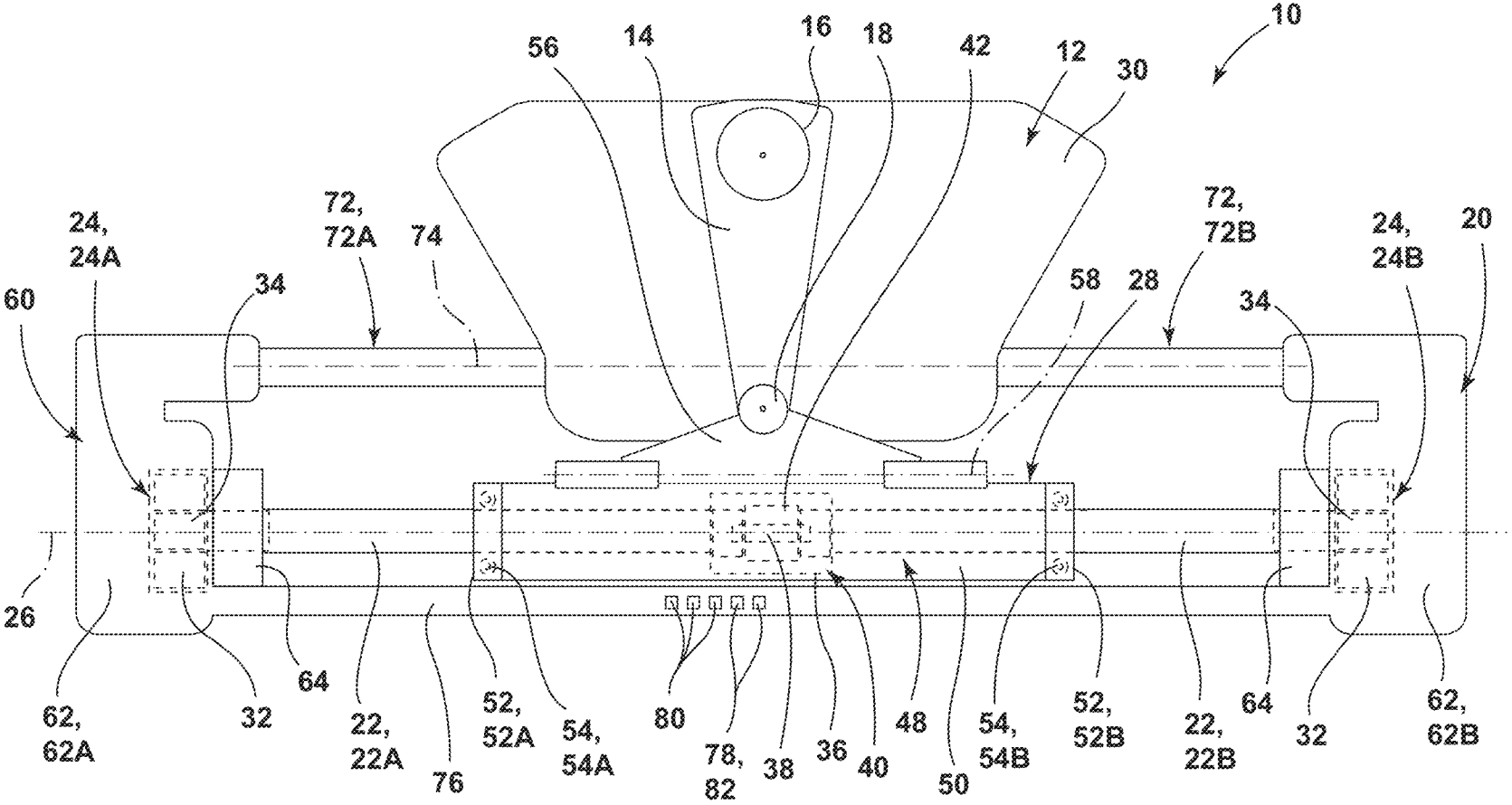
FIG. 1 is a top plan view of a marine steering system that includes an electric actuator according to an exemplary embodiment of the present disclosure.

The components in the figures are not necessarily to scale, emphasis instead being placed upon illustrating the principles described herein.

DETAILED DESCRIPTION

Additional features and advantages of the disclosure will be set forth in the detailed description which follows and will be apparent to those skilled in the art from the description, or recognized by practicing the disclosure as described in the following description, together with the claims and appended drawings.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

In this document, relational terms, such as "first" and "second," "top" and "bottom," and the like, are used solely to distinguish one entity or action from another entity or action, without necessarily requiring or implying any actual such relationship or order between such entities or actions.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and/or any additional intermediate members. Such joining may include members being integrally formed as a single unitary body with one another (i.e., integrally coupled) or may refer to joining of two components. Such joining may be permanent in nature, or may be removable or releasable in nature, unless otherwise stated.

As used herein, the terms "the," "a," or "an," mean "at least one," and should not be limited to "only one" unless explicitly indicated to the contrary. Thus, for example, reference to "a component" includes embodiments having two or more such components unless the context clearly indicates otherwise.

As used herein, the term "axial" and derivatives thereof, such as "axially," shall be understood to refer to a direction along an axis. Further, the term "radial" and derivatives thereof, such as "radially," shall be understood in relation to the aforementioned axis. For example, "radially outboard" refers to further away from the axis, while "radially inboard" refers to nearer to the axis. The term "circumferential" and derivatives thereof, such as "circumferentially," shall be understood in relation to the aforementioned axis. Further, the term "coaxial" and derivatives thereof, such as "coaxially aligned," shall be understood to refer to elements configured to rotate about a common axis. Unless context clearly indicates otherwise, "axial," "radial," "circumferential," and respective derivatives thereof shall be understood in reference to an axis about which an output shaft of the marine steering system rotates.

Referring now to FIGS. 1-4, a marine steering system 10 includes a marine propulsion unit 12. A steering tiller 14 includes a first end 16 and a second end 18 opposite the first end 16. The steering tiller 14 is pivotably coupled to the marine propulsion unit 12 proximate to the second end 18 of the steering tiller 14. The marine steering system 10 includes an electric actuator 20. The electric actuator 20 includes an output shaft 22, a motor 24 that drives rotation of the output shaft 22 about an axis 26, and a driven assembly 28. The driven assembly 28 is pivotably coupled with the steering tiller 14 proximate to the first end 16 of the steering tiller 14 and is operably coupled with the output shaft 22. Rotation of the output shaft 22 by the motor 24 drives axial movement of the driven assembly 28 relative to the output shaft 22 and the motor 24 to steer the marine propulsion unit 12 via the steering tiller 14.

Referring now to FIG. 1, the marine steering system 10 includes the marine propulsion unit 12. The marine propulsion unit 12 is configured to be coupled with a marine vessel (not shown) and to propel the marine vessel within a body of water. The marine propulsion unit 12 can be an engine 30, such as an outboard engine configured to be mounted proximate a stern of the marine vessel. Various arrangements and types of marine propulsion units 12 (e.g., electric motor) are contemplated. The marine propulsion unit 12 may be configured to pivot and/or turn relative to the marine vessel to allow for steering of the marine vessel, as described further herein.

Referring still to FIG. 1, the marine steering system 10 can include the steering tiller 14. As illustrated exemplarily in FIG. 1, the steering tiller 14 extends from the first end 16 to the second end 18 that is opposite the first end 16. The steering tiller 14 may be pivotably coupled to the marine propulsion unit 12. As illustrated in FIG. 1, the steering tiller 14 is pivotably coupled to the marine propulsion unit 12 proximate to the second end 18 of the steering tiller 14. In various implementations, the steering tiller 14 may also be pivotably coupled with the driven assembly 28 of the electric actuator 20 to operably couple the marine propulsion unit 12 with the electric actuator 20, such that actuation of the electric actuator 20 prompts pivoting and/or turning of the marine propulsion unit 12 to steer the marine vessel.

Figure 3:
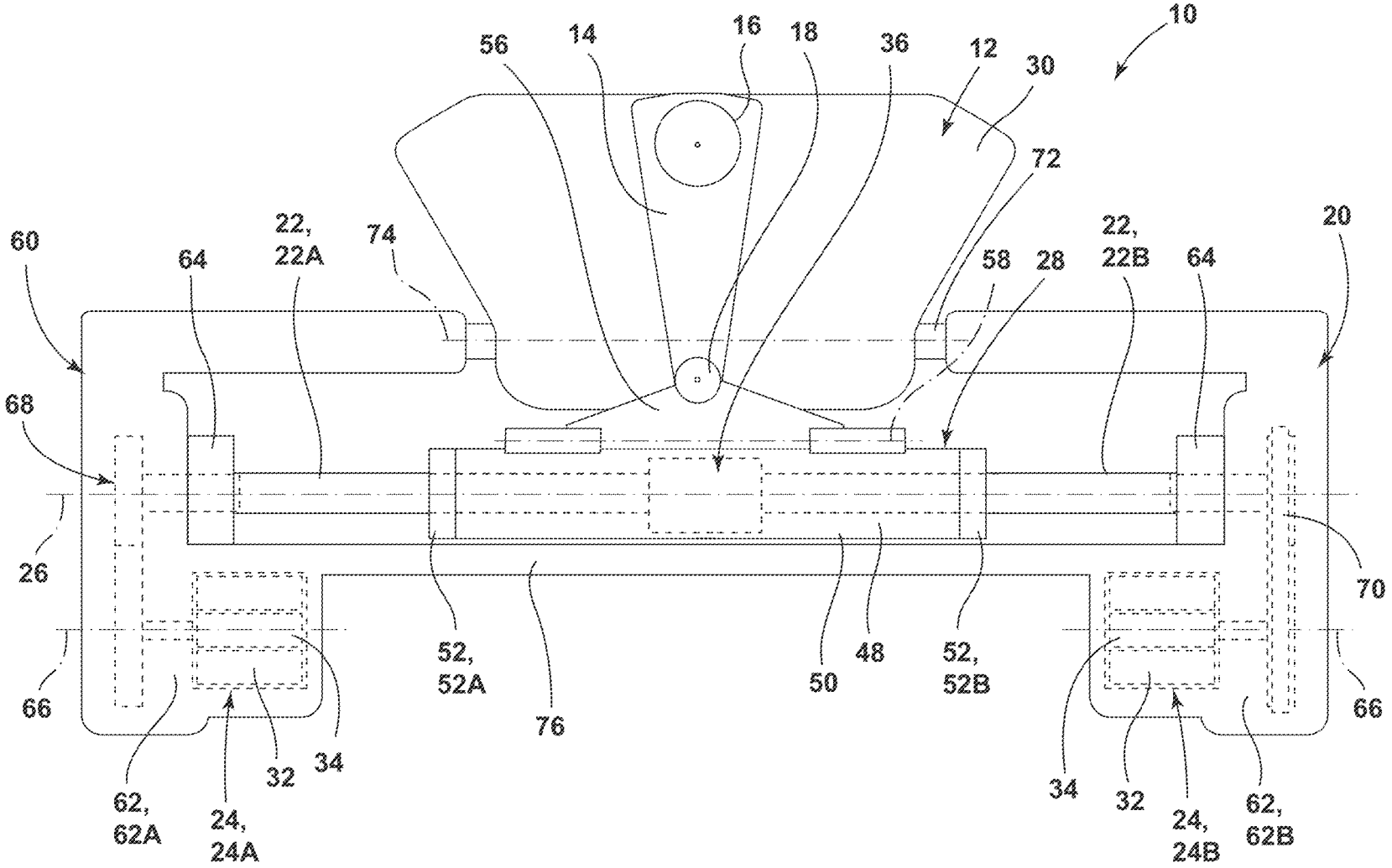
FIG. 3 is a top plan view of a marine steering system that includes an electric actuator having a first motor drivingly engaged with a first output shaft via a gear train and a second motor drivingly engaged with a second output shaft via a belt according to an exemplary embodiment of the present disclosure.

Referring now to FIGS. 1 and 3, the marine steering system 10 includes the electric actuator 20. The electric actuator 20 includes the motor 24. The motor 24 can include a stator 32 and a rotor 34 that is configured to rotate relative to the stator 32 about a rotor axis 66 in operation of the motor 24. The motor 24 is drivingly engaged with the output shaft 22, such that the motor 24 is operable to drive rotation of the output shaft 22 about the axis 26. In some implementations, the electric actuator 20 includes a plurality of motors 24. For example, as illustrated in FIG. 1, the electric actuator 20 includes a first motor 24A and a second motor 24B. In some implementations, the electric actuator 20 can include a plurality of output shafts 22. For example, in the embodiment of the electric actuator 20 illustrated in FIG. 1, the electric actuator 20 includes a first output shaft 22A and a second output shaft 22B. In the illustrated embodiment, the first motor 24A is drivingly engaged with the first output shaft 22A, the second motor 24B is drivingly engaged with the second output shaft 22B, and the first and second output shafts 22A, 22B are coaxially aligned, such that at least one of the first motor 24A and the second motor 24B is operable to drive rotation of the first and second output shafts 22A, 22B about the axis 26.

Figure 2:
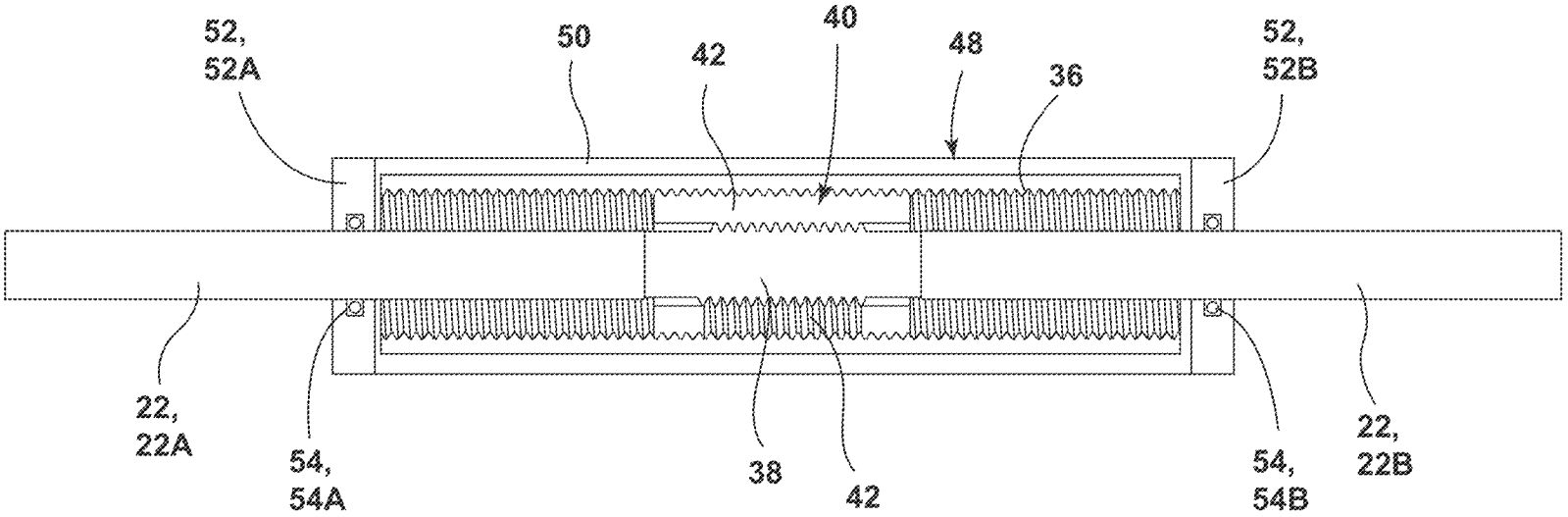
FIG. 2 is a cross-sectional view of a portion of an electric actuator for a marine steering system, illustrating first and second output shafts that extend outward from a housing that houses a roller screw assembly according to an exemplary embodiment of the present disclosure.

Referring now to FIGS. 1 and 2, the electric actuator 20 includes the driven assembly 28. The driven assembly 28 is operably coupled with the output shaft 22, such that rotation of the output shaft 22 by the motor 24 drives axial movement of the driven assembly 28 relative to the output shaft 22 and the motor 24. In various implementations, rotation of the output shaft 22 by the motor 24 in a first rotational direction drives axial movement of the driven assembly 28 relative to the output shaft 22 and the motor 24 in a first axial direction, and rotation of the output shaft 22 by the motor 24 in a second rotational direction opposite the first rotational direction drives axial movement of the driven assembly 28 relative to the output shaft 22 and the motor 24 in a second axial direction that is opposite the first axial direction. As such, in operation of the electric actuator 20, the driven assembly 28 may reciprocate axially due to the motor 24 driving rotation of the output shaft 22 in the first and second rotational directions.

Referring still to FIGS. 1 and 2, the driven assembly 28 can include a nut tube 36. A central screw 38 that is fixedly coupled with the output shaft 22 may be received within the nut tube 36. In other words, the central screw 38 may be disposed radially inboard of the nut tube 36 within a hollow defined by a threaded interior of the nut tube 36. In various implementations, the nut tube 36 is translatable along the axis 26 for axial displacement relative to the central screw 38 in response to the motor 24 rotating the output shaft 22 to which the central screw 38 is fixedly coupled. In other words, rotation of the output shaft 22 and the central screw 38 that is fixedly coupled with the output shaft 22 may prompt the nut tube 36 to move axially while remaining rotationally stationary with respect to the axis 26.

In some embodiments, the nut tube 36 and the central screw 38 are components of a roller screw assembly 40 of the marine steering system 10. For example, as illustrated in FIG. 2, the roller screw assembly 40 includes the central screw 38 that is fixedly coupled with the output shaft 22, the nut tube 36 that receives the central screw 38 therein, and a plurality of rollers 42 that are disposed radially between the central screw 38 and the nut tube 36. The plurality of rollers 42 are configured to engage the central screw 38 and the nut tube 36, such that rotation of the central screw 38 by the output shaft 22 causes the rollers 42 to effect axial movement of the nut tube 36 relative to the central screw 38.

Figure 4:
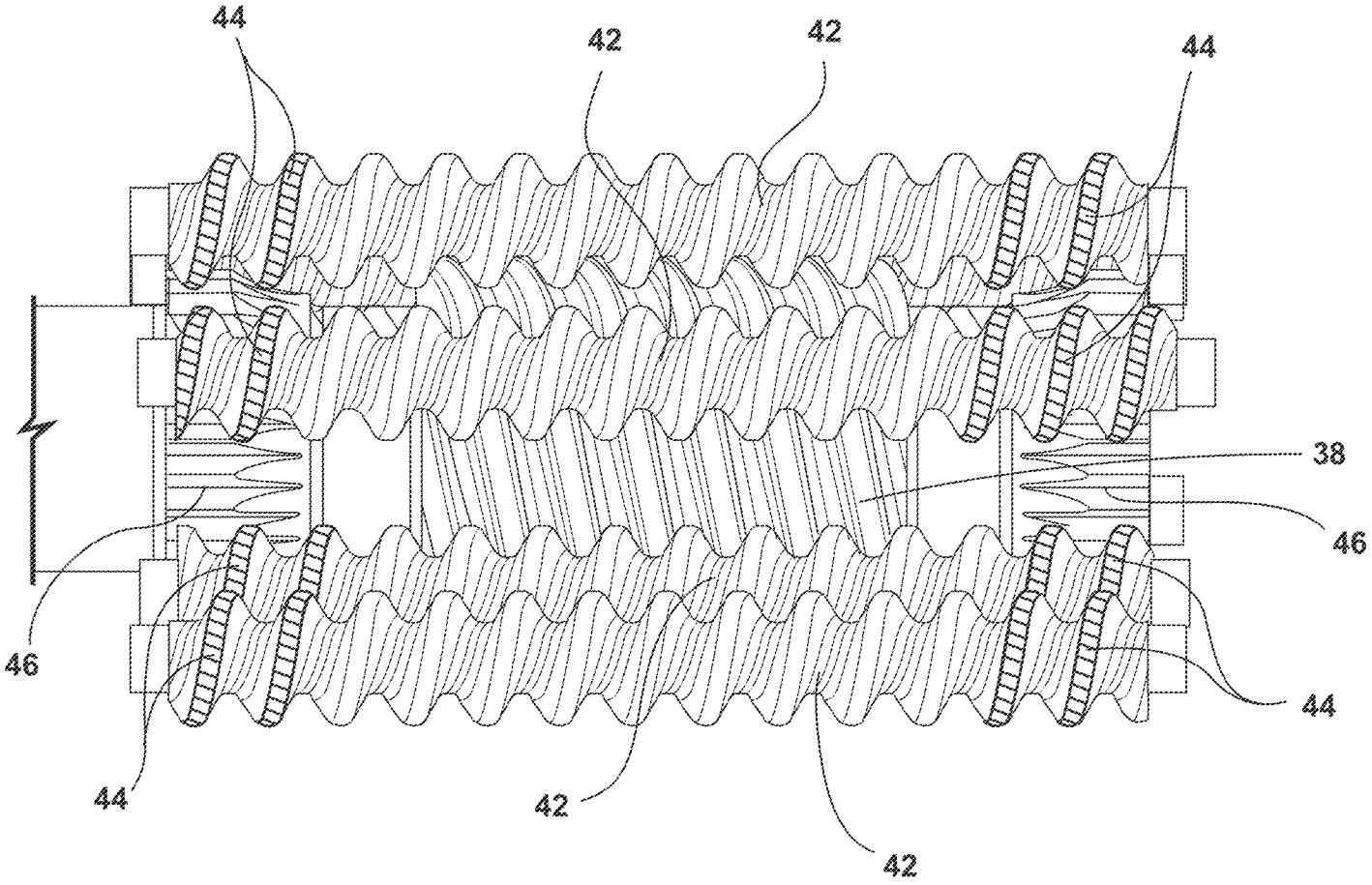
FIG. 4 is a top plan view of a plurality of rollers and a central screw of a roller screw assembly of an electric actuator for a marine steering system according to an exemplary embodiment of the present disclosure.

In the embodiment illustrated in FIG. 2, the rollers 42 have threads that engage with corresponding threads of the central screw 38 and of the nut tube 36. The threaded rollers 42 are engaged in such a way that the rollers 42 rotate about axes (not shown) that are parallel to the axis 26 and revolve in planetary fashion about the axis 26 while the central screw 38 is rotating. In some implementations, the plurality of rollers 42 are non-translatably connected with the central screw 38 of the roller screw assembly 40. In other words, the axial position of each of the plurality of rollers 42 is fixed relative to the central screw 38. An exemplary embodiment of threaded planetary rollers 42 is illustrated in FIG. 4. In the illustrated embodiment, the threads of the rollers 42 and the threads of the central screw 38 have helix angles that can cause skewing of the rollers 42 under load. As illustrated in FIG. 4, the rollers 42 include geared ends 44 that correspond with toothed or geared interfaces 46 arranged correspondingly on the central screw 38 to prevent skewing. It is contemplated that the roller screw assembly 40 can include a variety of types of rollers 42 (e.g., balls), in various implementations. Further, it is contemplated that the threads of the central screw 38 may directly correspond with the threads of the nut tube 36, in some implementations.

Referring now to FIGS. 1 and 2, the driven assembly 28 includes a housing 48. In various implementations, the nut tube 36 is housed by and fixed relative to the housing 48. As such, the housing 48 can translate with the nut tube 36 along the axis 26 in response to the motor 24 rotating the output shaft 22. In the embodiment illustrated in FIG. 1, the entire roller screw assembly 40 is arranged within the housing 48. In various implementations, the output shaft 22 extends axially outward from the housing 48. As illustrated in FIG. 1, the first output shaft 22A extends axially outward from the housing 48 in the first axial direction, and the second output shaft 22B extends axially outward from the housing 48 in the second axial direction opposite the first axial direction.

Referring still to FIGS. 1 and 2, the housing 48 may be formed of a plurality of components that cooperate to form an enclosure that is sealed to prevent outside contaminants, such as saltwater, from entering the enclosure where the nut tube 36 is arranged. In an exemplary embodiment, the housing 48 includes a main body 50 that extends circumferentially around and is fixed to the nut tube 36, a bushing 52 coupled to the main body 50 at an axial end thereof for receiving and facilitating rotation of the output shaft 22 that extends therethrough, and a seal 54, such as an O-ring, that extends radially between the output shaft 22 and the bushing 52, such that the main body 50, bushing 52, seal 54, and output shaft 22 cooperate to seal the enclosure defined by the housing 48. In operation of the exemplary embodiment of the electric actuator 20, rotation of the output shaft 22 prompts axial movement of the nut tube 36 and the housing 48 fixed thereto, such that the main body 50, bushing 52, and seal 54 move axially relative to the output shaft 22. In order for the housing 48 to maintain a sealed enclosure, the seal 54 must maintain sufficient contact with an outer surface of the output shaft 22 as the housing 48 moves axially along the output shaft 22. Accordingly, the axial extent of the outer surface of the output shaft 22 with which the seal 54 must maintain contact during operation of the electric actuator 20 may be cylindrical and smooth to ensure a consistent interface between the output shaft 22 and the seal 54. It is contemplated that the housing 48 may include other sealing means that accommodate movement of the housing 48 relative to the output shaft 22, such as bellows, in some embodiments.

As illustrated in FIG. 2, the housing 48 includes the main body 50 that extends circumferentially around the roller screw assembly 40, a first bushing 52A coupled to the main body 50 proximate a first axial end of the main body 50, a second bushing 52B coupled to the main body 50 proximate a second axial end of the main body 50 opposite the first axial end, and first and second seals 54A, 54B coupled with the first and second bushings 52A, 52B, respectively. The first output shaft 22A is fixedly coupled with the central screw 38 and extends axially outward therefrom through the first bushing 52A in the first axial direction. The second output shaft 22B is fixedly coupled to the central screw 38 and extends axially outward therefrom through the second bushing 52B in the second axial direction. The first seal 54A extends radially between the first bushing 52A and the output shaft 22, and the second seal 54B extends radially between the second bushing 52B and the second output shaft 22B to seal the enclosure defined by the housing 48.

Referring now to FIGS. 1 and 3, the driven assembly 28 can include a pivot plate 56. The pivot plate 56 can be pivotably coupled to the housing 48 and operable to pivot relative to the housing 48 about a pivot plate axis 58 that is parallel to the axis 26 about which the output shaft 22 rotates. As illustrated in FIGS. 1 and 3, the steering tiller 14 is pivotably coupled with the driven assembly 28 via a pivotal coupling with the pivot plate 56. In other words, the steering tiller 14 is pivotably coupled with the pivot plate 56 of the driven assembly 28. As such, in the embodiments illustrated in FIGS. 1 and 3, the pivot plate 56 is operable to pivot relative to the housing 48 about the pivot plate axis 58, and the steering tiller 14 is operable to pivot relative to the pivot plate 56. In the embodiment illustrated in FIGS. 1 and 3, the steering tiller 14 is pivotably coupled with the marine propulsion unit 12 proximate the second end 18 of the steering tiller 14 and is pivotably coupled with the pivot plate 56 proximate the first end 16 of the steering tiller 14. The steering tiller 14 being pivotably coupled with the marine propulsion unit 12 and the driven assembly 28 of the electric actuator 20 in this way allows for controlling steering of the marine propulsion unit 12 via actuation of the electric actuator 20, as described further herein.

Referring still to FIGS. 1 and 3, the electric actuator 20 includes a support structure 60. The support structure 60 can support various components of the electric actuator 20. For example, the support structure 60 can support the motor 24 and the output shaft 22 of the electric actuator 20. In an exemplary embodiment, the motor 24 is housed by a support arm 62 of the support structure 60 that is axially offset from the housing 48. The motor 24 is housed by the support arm 62, such that axial movement of the motor 24 and rotational movement of the stator 32 of the motor 24 is inhibited by the support arm 62. In some implementations, the support arm 62 of the support structure 60 inhibits axial movement of the output shaft 22. The support arm 62 can have a bearing 64 coupled thereto that supports and facilitates rotation of the output shaft 22, as illustrated in FIGS. 1 and 3. In some embodiments, the support structure 60 may include a plurality of support arms 62. For example, in the embodiment illustrated in FIG. 1, the support structure 60 includes a first support arm 62A and a second support arm 62B.

In various embodiments, the motor 24 of the electric actuator 20 is arranged externally of the housing 48 that houses the nut tube 36. For example, in the embodiment illustrated in FIG. 1, the first motor 24A is housed within the first support arm 62A of the support structure 60, wherein the motor 24 is axially offset from the housing 48 and arranged external to the housing 48. The electric actuator 20 of FIG. 1 further includes the second motor 24B that is housed within the second support arm 62B of the support structure 60 that is positioned axially opposite the first support arm 62A. The second motor 24B, like the first motor 24A, is axially offset from and arranged external to the housing 48 that houses the nut tube 36. In the illustrated embodiment, the first and second motors 24A, 24B are coaxial with the first and second output shafts 22A, 22B, such that the first and second output shafts 22A, 22B and rotors 34 of the first and second motors 24A, 24B rotate about the axis 26. In some implementations, the motor 24 of the electric actuator 20 is positioned such that a rotor axis 66 about which the rotor 34 of the motor 24 rotates relative to the stator 32 is radially offset from the axis 26 about which the output shaft 22 rotates. For example, in the embodiment illustrated in FIG. 3, the rotor axes 66 of the first and second motors 24A, 24B are radially offset from the axis 26 about which the first and second output shafts 22A, 22B rotate. Operability of the electric actuator 20 with this arrangement of motors 24 can be achieved by utilizing an intermediate structure that transfers the rotative force of the motor 24 to the offset output shaft 22. For example, in the embodiment illustrated in FIG. 3, the first motor 24A is drivably connected to the first output shaft 22A via a gearset 68, and the second motor 24B is drivably connected to the second output shaft 22B via a belt 70. While the embodiment illustrated in FIG. 3 exemplarily includes the gearset 68 and the belt 70, it is to be understood that the first and second motors 24A, 24B can be drivably connected to the first and second output shafts 22A, 22B by various types and combinations of types of intermediate structures (e.g., first and second gearsets 68, first and second belts 70, etc.).

Referring now to FIGS. 1 and 3, the electric actuator 20 can include a mounting shaft 72. The mounting shaft 72 can be coupled to the support structure 60 and is configured to facilitate pivotal movement of the support structure 60, the motor 24, the output shaft 22, and the housing 48 of the electric actuator 20 about a pivot axis 74. The pivot axis 74 can extend parallel to the axis 26 about which the output shaft 22 rotates and/or the pivot plate axis 58 about which the pivot plate 56 rotates relative to the housing 48. As illustrated in FIGS. 1 and 3, the pivot axis 74 is radially offset from the axis 26 about which the output shaft 22 pivots and the pivot plate axis 58. In various implementations, the mounting shaft 72 is coupled with a mounting structure (not shown) of the marine steering system 10, such as an engine mounting bracket, and is configured to facilitate pivotal movement of the support structure 60, motor 24, output shaft 22, and housing 48 about the pivot axis 74 by rotating relative to the mounting structure or providing a bracing interface, such as a rotationally-stationary cylindrical surface, that the support structure 60, motor 24, output shaft 22, and housing 48 rotate relative to in unison.

In various implementations, the mounting shaft 72 is elongated in the axial direction of the pivot axis 74, and the pivot axis 74 extends through the mounting shaft 72 or within a hollow defined by the mounting shaft 72. In some implementations, the electric actuator 20 can include a plurality of mounting shafts 72, such as a first mounting shaft 72A and a second mounting shaft 72B that extend to the mounting structure from the first support arm 62A of the support structure 60 and the second support arm 62B of the support structure 60, respectively. In various implementations, the marine propulsion unit 12 is operable to pivot about the pivot axis 74, such as when trimming the marine propulsion unit 12 up or down.

In some implementations, the support structure 60 can include a front housing 76 that extends axially between the first support arm 62A and the second support arm 62B of the support structure 60. In various implementations, the front housing 76 may be arranged such that the housing 48 that houses the nut tube 36 is disposed between the front housing 76 of the support structure 60 and the steering tiller 14 of the marine steering system 10. In some implementations, the front housing 76 is positioned marine vessel-forward of the housing 48 that houses the nut tube 36. The front housing 76 may support additional components of the electric actuator 20, such as sensors 78 and lights 80. In an exemplary implementation, the front housing 76 may support a linear sensor 82 configured to detect a translational position of the housing 48 along the axis 26. In some embodiments, the front housing 76 may support one or more lights 80 configured to activate in response to an operating condition of the electric actuator 20 to, for example, indicate the status of operation of the electric actuator 20, diagnostics of the electric actuator 20, and/or a variety of other conditions.

In an exemplary embodiment of the marine steering system 10, illustrated in FIG. 1, the marine steering system 10 includes the marine propulsion unit 12. The steering tiller 14 is pivotably coupled to the marine propulsion unit 12 proximate to the second end 18 of the steering tiller 14. The electric actuator 20 includes the housing 48. The pivot plate 56 is pivotably coupled with the housing 48 and is operable to pivot relative to the housing 48 about the pivot plate axis 58. The steering tiller 14 is pivotably coupled with the pivot plate 56 proximate to the first end 16 of the steering tiller 14, such that the pivot plate 56 is operable to pivot relative to the housing 48 about the pivot plate axis 58, and the steering tiller 14 is operable to pivot relative to the pivot plate 56. The first output shaft 22A extends axially outward from the housing 48 in the first axial direction. The second output shaft 22B extends axially outward from the housing 48 in the second axial direction opposite the first axial direction. The first motor 24A is arranged external to the housing 48 within the first support arm 62A of the support structure 60 and is drivingly engaged with the first output shaft 22A, such that the first motor 24A is operable to drive rotation of the first output shaft 22A about the axis 26. The second motor 24B is arranged external to the housing 48 within the second support arm 62B of the support structure 60 and is drivingly engaged with the second output shaft 22B, such that the second motor 24B is operable to drive rotation of the second output shaft 22B about the axis 26. The roller screw assembly 40 is arranged within the housing 48 and is coupled to the first and second output shafts 22A, 22B. The roller screw assembly 40 includes the nut tube 36 that is fixed relative to the housing 48. The roller screw assembly 40 further includes the central screw 38 that is received by the nut tube 36. The nut tube 36 is axially translatable relative to the central screw 38 in response to at least one of the first motor 24A driving rotation of the first output shaft 22A and the second motor 24B driving rotation of the second output shaft 22B. The mounting shaft 72 extends axially between the first and second support arms 62A, 62B.

In operation of the exemplary embodiment of the marine steering system 10 illustrated in FIG. 1, a steering command prompts the first motor 24A and the second motor 24B to drive rotation of the first and second output shafts 22A, 22B about the axis 26. Rotation of the first and second output shafts 22A, 22B causes the central screw 38 extending axially therebetween to rotate about the axis 26, which drives axial movement of the nut tube 36. The housing 48, being fixedly coupled with the nut tube 36, translates axially with the nut tube 36. This translation of the housing 48 results in turning of the marine propulsion unit 12 on account of (1) the pivot plate 56 being pivotably coupled to the housing 48 and operable to pivot relative to the housing 48 about the pivot plate axis 58, (2) the steering tiller 14 being pivotably coupled to the pivot plate 56 proximate the first end 16 of the steering tiller 14, (3) the steering tiller 14 being pivotably coupled to the marine propulsion unit 12 proximate to the second end 18 of the steering tiller 14, and (4) the support structure 60, first and second motors 24A, 24B, first and second output shafts 22A, 22B, roller screw assembly 40, and housing 48 being operable to pivot about the pivot axis 74 extending through the mounting shaft 72. As such, in a full stroke actuation of the electric actuator 20 that steers the marine propulsion unit 12, (1) the nut tube 36 and housing 48 translate axially, (2) the pivot plate 56 pivots relative to the housing 48 about the pivot plate axis 58 such that the portion of the pivot plate 56 that the steering tiller 14 is pivotably coupled to moves along an arc, (3) the steering tiller 14 pivots relative to the pivot plate 56, (4) the steering tiller 14 pivots relative to the marine propulsion unit 12, and (5) the support structure 60, first and second motors 24A, 24B, first and second output shafts 22A, 22B, roller screw assembly 40, and housing 48 pivot about the pivot axis 74. As used herein, a "full stroke actuation" of the electric actuator 20 shall be understood to refer to an actuation of the electric actuator 20 that prompts axial movement of the nut tube 36 from a first axial end limit of the nut tube 36 to a second axial end limit of the nut tube 36. In various implementations, limit switches may be utilized to set the axial end limits, and the axial end limits may be adjustable to allow for modification of the axial length between the axial end limits, in some embodiments.

The marine steering system 10 and the electric actuator 20 of the marine steering system 10 of the present disclosure may provide a variety of advantages. First, axially fixing the motor 24 relative to the support arm 62 of the electric actuator 20 reduces movement of motor cables (i.e., cables for electrical connection) during steering of the marine propulsion unit 12, which improves durability of the motor cables. Second, the electric actuator 20 having the first motor 24A and the second motor 24B advantageously allows for continued operation of the marine steering system 10 in the event that the first or second motor 24A, 24B stops working. In particular, having two motors 24 that are each operable to apply twice the amount of torque necessary to operate the marine steering system 10 may safeguard against failure of one of the first and second motors 24A, 24B. Third, the electric actuator 20 having the motor 24 arranged external to the housing 48 that houses the nut tube 36 reduces the footprint of the electric actuator 20 in the area that the electric actuator 20 is axially aligned with the marine propulsion unit 12. This is particularly advantageous as additional clearance for trimming or tilting of the marine propulsion unit 12 out of the water is provided.

It is to be understood that variations and modifications can be made on the aforementioned structure without departing from the concepts of the present disclosure, and further it is to be understood that such concepts are intended to be covered by the following claims unless these claims by their language expressly state otherwise.

LIST OF REFERENCE NUMERALS

10 marine steering system
12 marine propulsion unit
14 steering tiller
16 first end
18 second end
20 electric actuator
22 output shaft
22A first output shaft
22B second output shaft
24 motor
24A first motor
24B second motor
26 axis
28 driven assembly
30 engine
32 stator
34 rotor
36 nut tube
38 central screw
40 roller screw assembly
42 rollers
44 geared ends
46 geared interfaces
48 housing
50 main body
52 bushing
52A first bushing
52B second bushing
54 seal
54A first seal
54B second seal
56 pivot plate
58 pivot plate axis
60 support structure
62 support arm
62A first support arm
62B second support arm
64 bearing
66 rotor axis
68 gearset
70 belt
72 mounting shaft
72A first mounting shaft
72B second mounting shaft
74 pivot axis
76 front housing
78 sensors
80 lights
82 linear sensor

What is claimed is:

1. A marine steering system, comprising:
a marine propulsion unit;
a steering tiller having a first end and a second end opposite the first end and being pivotably coupled to the marine propulsion unit proximate the second end; and
an electric actuator, comprising:
an output shaft;
a motor that drives rotation of the output shaft about an axis;
a support structure having a support arm configured to inhibit axial movement of the output shaft, wherein the motor is housed by the support arm, such that axial movement of the motor relative to the support arm is inhibited; and
a driven assembly pivotably coupled with the steering tiller proximate the first end and operably coupled with the output shaft, such that rotation of the output shaft by the motor drives axial movement of the driven assembly relative to the output shaft and the motor to steer the marine propulsion unit via the steering tiller, wherein the driven assembly comprises:
a housing, wherein the support arm is axially offset from the housing;
a nut tube that is housed by and fixed relative to the housing and that receives a central screw that is fixedly coupled with the output shaft therein, wherein the nut tube is translatable along the axis in response to the motor rotating the output shaft; and
a pivot plate pivotably coupled to the housing and operable to pivot relative to the housing about a pivot plate axis that is parallel to the axis about which the output shaft rotates, wherein the steering tiller is pivotably coupled with the driven assembly via a pivotal coupling with the pivot plate, such that the pivot plate is operable to pivot relative to the housing about the pivot plate axis, and the steering tiller is operable to pivot relative to the pivot plate.

2. The marine steering system of claim 1, wherein the marine steering system includes a roller screw assembly that comprises:
the central screw fixedly coupled with the output shaft;
the nut tube that receives the central screw therein; and
a plurality of rollers disposed radially between the central screw and the nut tube and configured to engage the central screw and the nut tube.

3. The marine steering system of claim 2, wherein the plurality of rollers are non-translatably connected with the central screw, such that the axial position of each of the plurality of rollers is fixed relative to the central screw.

4. The marine steering system of claim 1, wherein the motor is arranged external to the housing.

5. The marine steering system of claim 1, wherein the motor is axially offset from the entirety of the driven assembly.

6. The marine steering system of claim 1, wherein the motor and the output shaft are coaxially aligned, such that the motor and the output shaft rotate about the axis.

7. The marine steering system of claim 1, wherein the motor includes a stator and a rotor that is configured to rotate relative to the stator about a rotor axis that is radially offset from the axis about which the output shaft rotates.

8. The marine steering system of claim 7, wherein the motor is drivably connected to the output shaft via a gearset.

9. The marine steering system of claim 7, wherein the motor is drivably connected to the output shaft via a belt.

10. The marine steering system of claim 1, wherein the electric actuator further comprises:

a mounting shaft coupled to the support structure and configured to facilitate pivotal movement of the support structure, the motor, the output shaft, and the housing about a pivot axis that extends parallel to the axis and is radially offset from the axis and the pivot plate axis.

11. The marine steering system of claim 10, wherein a full stroke actuation of the electric actuator prompts pivotal movement of the support structure, the motor, the output shaft, and the housing about the pivot axis, pivotal movement of the pivot plate relative to the housing about the pivot plate axis, pivotal movement of the steering tiller relative to the pivot plate, and pivotal movement of the steering tiller relative to the marine propulsion unit.

12. The marine steering system of claim 1, wherein the marine propulsion unit is an engine.

13. An electric actuator for a marine steering system, comprising:

a housing;

a first output shaft extending axially outward from the housing in a first axial direction;

a first motor arranged external to the housing and drivingly engaged with the first output shaft, such that the first motor is operable to drive rotation of the first output shaft about an axis;

a roller screw assembly arranged within the housing and coupled to the first output shaft, the roller screw assembly having a nut tube fixed relative to the housing and a central screw received by the nut tube, wherein the nut tube is axially translatable in response to the first motor rotating the first output shaft and the central screw about the axis;

a second output shaft coupled with the roller screw assembly and extending axially outward from the housing in a second axial direction opposite the first axial direction; and a second motor arranged external to the housing and drivingly engaged with the second output shaft.

14. The electric actuator of claim 13, further comprising:

a pivot plate pivotably coupled to the housing and operable to pivot relative to the housing about a pivot plate axis that is parallel to the axis about which the first output shaft rotates, the pivot plate being configured to have a steering tiller of the marine steering system pivotably coupled thereto.

15. The electric actuator of claim 13, wherein rotation of the first output shaft prompts axial translation of the nut tube relative to the first motor.

16. A marine steering system, comprising:

a marine propulsion unit;

a steering tiller having a first end and a second end opposite the first end and being pivotably coupled to the marine propulsion unit proximate the second end; and an electric actuator, comprising:

a housing;

a pivot plate pivotably coupled with the housing and operable to pivot relative to the housing about a pivot plate axis, wherein the steering tiller is pivotably coupled with the pivot plate proximate the first end of the steering tiller, such that the pivot plate is operable to pivot relative to the housing about the pivot plate axis, and the steering tiller is operable to pivot relative to the pivot plate;

a first output shaft extending axially outward from the housing in a first axial direction;

a second output shaft extending axially outward from the housing in a second axial direction opposite the first axial direction;

a first motor arranged external to the housing and drivingly engaged with the first output shaft, such that the first motor is operable to drive rotation of the first output shaft about an axis;

a second motor arranged external to the housing and drivingly engaged with the second output shaft, such that the second motor is operable to drive rotation of the second output shaft about the axis; and a roller screw assembly arranged within the housing and coupled to the first and second output shafts, the roller screw assembly having a nut tube fixed relative to the housing and a central screw received by the nut tube, wherein the nut tube is configured to axially translate along the axis in response to rotation of the central screw via at least one of the first motor driving rotation of the first output shaft and the second motor driving rotation of the second output shaft.

* * * * *